US008698411B2

(12) United States Patent
Kontani et al.

(10) Patent No.: US 8,698,411 B2
(45) Date of Patent: Apr. 15, 2014

(54) DISCHARGE LAMP LIGHTING APPARATUS

(75) Inventors: Toru Kontani, Hyogo (JP); Takashi Yamashita, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 121 days.

(21) Appl. No.: 13/477,738

(22) Filed: May 22, 2012

(65) Prior Publication Data

US 2012/0299504 A1 Nov. 29, 2012

(30) Foreign Application Priority Data

May 25, 2011 (JP) ..... 2011-116960

(51) Int. Cl.
*H01J 61/06* (2006.01)
*H05B 41/16* (2006.01)

(52) U.S. Cl.
USPC ..... 315/246; 315/248

(58) Field of Classification Search
None
See application file for complete search history.

(56) References Cited

U.S. PATENT DOCUMENTS

| | | | | |
|---|---|---|---|---|
| 2,563,585 | A * | 8/1951 | Dällenbach | 315/4 |
| 3,758,815 | A * | 9/1973 | Paget | 315/101 |
| 5,061,841 | A * | 10/1991 | Richardson | 219/130.01 |
| 5,789,723 | A * | 8/1998 | Hirst | 219/501 |
| 6,087,783 | A * | 7/2000 | Eastlund et al. | 315/246 |
| 6,225,754 | B1 * | 5/2001 | Horiuchi et al. | 315/246 |
| 6,456,015 | B1 * | 9/2002 | Lovell et al. | 315/248 |
| 7,514,878 | B2 * | 4/2009 | Crandall et al. | 315/224 |
| 8,054,000 | B2 * | 11/2011 | Mizojiri et al. | 315/246 |
| 8,294,382 | B2 * | 10/2012 | DeVincentis et al. | 315/248 |
| 2002/0074953 | A1 * | 6/2002 | Lovell et al. | 315/248 |
| 2005/0007023 | A1 | 1/2005 | Arimoto et al. | |
| 2005/0104537 | A1 * | 5/2005 | Crandall et al. | 315/224 |
| 2010/0060183 | A1 * | 3/2010 | Tamai | 315/246 |
| 2010/0156288 | A1 | 6/2010 | Imamura et al. | |
| 2010/0171436 | A1 * | 7/2010 | DeVincentis et al. | 315/248 |

FOREIGN PATENT DOCUMENTS

| | | | |
|---|---|---|---|
| JP | 05-045994 | U | 6/1993 |
| JP | 2005-019262 | A | 1/2005 |
| JP | 2009-101887 | A | 5/2009 |
| JP | 2009-193768 | A | 8/2009 |
| JP | 2010-165661 | A | 7/2010 |
| JP | 2011-060641 | A | 3/2011 |

OTHER PUBLICATIONS

Office Action issued in Japansese Patent Application No. 2011-116960, dated Apr. 16, 2013.

* cited by examiner

*Primary Examiner* — Crystal L Hammond
(74) *Attorney, Agent, or Firm* — Rader, Fishman & Grauer PLLC

(57) ABSTRACT

In a discharge lamp lighting apparatus comprising a short arc type discharge lamp and a power supply unit, a relation of the natural frequency $f_e$ (Hz) of the electrodes, the ripple frequency $f_d$ (Hz) of the alternating current that is supplied to the discharge lamp, and the ripple power Pr (W) of the alternating current, satisfies a formula:

$$Pr \leq |f_e - f_d| \cdot \left(-0.13 \times \frac{Vh}{Va} + 3.0\right),$$

wherein the volume of the electrode head portion is represented as Vh and the volume of the segment of the electrode axis portion that projects into the arc tube is represented as Va. When the alternating current supplied to the discharge lamp satisfies the formula, it is possible to prevent or control damage in the electrode axis portion, since vibration produced in the electrodes during lighting of the discharge lamp is small even if the discharge lamp is lighted for a long time.

2 Claims, 7 Drawing Sheets

DISCHARGE LAMP LIGHTING APPARATUS

CROSS-REFERENCES TO RELATED APPLICATION

This application claims priority from Japanese Patent Application Serial No. 2011-116960 filed May 25, 2011, the contents of which are incorporated herein by reference in its entirety.

BACKGROUND

The present invention relates to a discharge lamp lighting apparatus, which can be suitably used, for example, as a light source for a projector apparatus, an exposure apparatus etc.

A short arc type discharge lamp, in which a pair of electrodes is arranged so as to face each other in an arc tube, may be used as a light source of a projector apparatus, an exposure apparatus etc. Japanese Patent Application Publication No. 2009-193768 describes such a discharge lamp with electrodes that each comprise an electrode head portion and an electrode axis portion that are integrally formed with each other by cutting and a coil that is wound around the electrode head portion. Japanese Patent Application Publication No. 2005-19262 describes a discharge lamp with an electrode in which a coil portion is formed by melting a coil wound around an electrode head portion. Moreover, Japanese Patent Application Publication No. 20010-165661 describes a discharge lamp with an electrode in which a cylindrical portion whose outer diameter is the same as a diameter of a back end of an electrode head portion is formed on a back end face of the electrode head portion.

However, as to these discharge lamps, if the lamp is lighted for a long time, there is a problem that damage such as a crack and an electrode crease, etc. arises in, for example, part of an electrode axis portion, which projects in the arc tube.

However, as a result of the inventors' earnest examination into the causes of such damage of the electrode axis portion, it turns out that vibration of the electrode is generated by a ripple in alternating current supplied to such a discharge lamp, so that the electrode axis portion is damaged.

Specifically, as shown in FIG. 11A, an electrode 95 of a discharge lamp has an electrode head portion 96, which is formed at the tip of an electrode axis portion 97, and a base end portion of the electrode axis portion 97 is buried and held in the sealing portion 92 of the arc tube 90, so that the electrode head portion 96 may be arranged so as to be located in the light emission section 91 of the arc tube 90. Since the mass of the electrode head portion 96 is fairly larger than that of the electrode axis portion 97, when the electrode 95 vibrates in a state where alternating current is supplied to the discharge lamp to be lighted, as shown in FIG. 11B, a portion of the electrode axis portion 97, which projects in the arc tube 90, is elastically deformed. When this phenomenon is repeated for a long time, damage such as a crack, an electrode crease, etc. arises in such a portion of the electrode axis portion 97. The present inventors examined the relation between the characteristic of alternating current supplied to the discharge lamp and the damage of the electrode 95, and found out that when the frequency of ripple of the alternating current is close to the natural frequency of the electrode 95, such damage tends to occur in the electrode 95, and the larger the power of ripple of the alternating current, the more such damage tend to occur in the electrode 95.

SUMMARY OF THE INVENTION

The present invention was made in view of the above-mentioned background, and it is an object of the present invention to offer a discharge lamp lighting apparatus capable of preventing or suppressing damage of an axis portion of an electrode, even when the discharge lamp is lighted for a long time.

A discharge lamp lighting apparatus according to embodiments of the present invention comprises a short arc type discharge lamp including an arc tube in which a pair of tungsten electrodes is arranged so as to face each other, each electrode having an electrode head portion, which is formed at the tip of an electrode axis portion, the electrode axis portion including a projection portion that projects into the arc tube, and a power supply unit, which supplies alternating current to the discharge lamp, configured to supply the alternating current such that a relation of a natural frequency $f_e$ (Hz) of the electrodes in the arc tube, which is obtained by a formula (1) shown below, a ripple frequency $f_d$ (Hz) of the alternating current, and a ripple power Pr (W) of the alternating current, satisfies a formula (2) shown below:

$$f_e = \left(\frac{a}{l_e}\right)^2 \cdot \sqrt{\frac{E \cdot I}{\rho \cdot S}} \qquad \text{Formula (1)}$$

In the formula (1), for a given electrode, an eigenvalue of bending vibration of a cantilever having a concentrated mass in the electrode is represented as "a", a value obtained by multiplying 0.623 by a distance (mm) from a base end of the projection portion of the electrode axis portion to the center of gravity of the electrode head portion, is represented as "$l_e$", a Young's modulus of the electrode is represented as "E", a second moment of area of the electrode axis portion is represented as "I", and a density of the electrode is represented as "ρ", and a cross-sectional area of a cross-section of the electrode axis portion taken along a direction perpendicular to an axial direction is represented as "S".

$$Pr \leq |f_e - f_d| \cdot \left(-0.13 \times \frac{Vh}{Va} + 3.0\right) \qquad \text{Formula (2)}$$

In the formula (2), the volume ($mm^3$) of the electrode head portion is represented as "Vh" and the volume ($mm^3$) of the projection portion of the electrode axis portion is represented as "Va".

In the discharge lamp lighting apparatus according to the present invention, it is desirable that the purity of the tungsten, which forms the electrodes, is 5N or more.

According to the discharge lamp lighting apparatus of the present invention, when alternating current supplied to the discharge lamp from a power supply unit satisfies the above-mentioned formula (2), since vibration produced in the electrode(s) during lighting of the discharge lamp is small, even if the discharge lamp is lighted for a long time, it is possible to prevent or control damage or breakage in the electrode axis portion.

BRIEF DESCRIPTION OF THE DRAWING

Other features and advantages of the present discharge lamp lighting apparatus will be apparent from the ensuing description, taken in conjunction with the accompanying drawings, in which.

DETAILED DESCRIPTION

A discharge lamp lighting apparatus according to embodiments of the present invention is explained below. The discharge lamp lighting apparatus according to the present invention comprises a short arc type discharge lamp and a power supply unit, which supplies alternating current to the discharge lamp.

Figure 1:
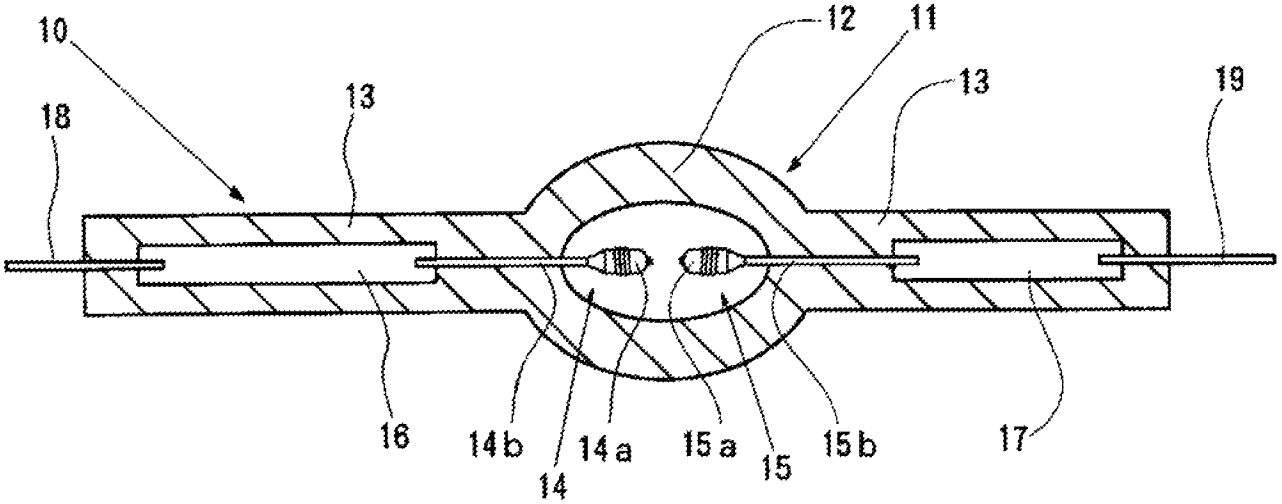
FIG. 1 is a cross sectional view of the structure of a discharge lamp.

FIG. 1 is an explanatory cross sectional view of an example of the structure of the discharge lamp used for a discharge lamp lighting apparatus according to an embodiment of the present invention. The discharge lamp 10 has an arc tube 11 which is made up of a light emission section 12 whose outer configuration is in an approximately prolate spheroid shape, which forms an electrical discharge space thereinside, and rod shape sealing portions 13 which are integrally continuously formed from respective ends of the light emission section 12 and which respectively extend outward along a tube axis thereof. A pair of electrodes 14 and 15 having the same structure as each other is arranged inside the light emission section 12 of the arc tube 11 so as to face each other along the tube axis of the arc tube 11. Each of the electrodes 14 and 15 comprises an electrode axis portion 14*b* (15*b*) and an approximately cylindrical electrode head portion 14*a* (15*a*) which has a diameter larger than that of the electrode axis portion 14*b* (15*b*) and which is formed continuously from the tip of the cylindrical electrode axis portion 14*b* (15*b*). Each of the electrodes 14 (15) is held by burying a base end portion of the electrode axis portion 14*b* (15*b*) in the sealing portion 13. A metallic foil 16 (17), for example made of molybdenum, is buried airtightly inside each of the sealing portions 13 of the arc tube 11. A base end of the electrode axis portion 14*b* (15*b*) of each of the pair of electrodes 14 (15) is welded and electrically connected to one end of each metallic foil 16 (17). On the other hand, an external lead 18 (19) which projects outward from an outer end of the sealing portion 13 is welded and electrically connected to the other end of each metallic foil 16 (17).

The arc tube 11 is made of, for example, silica glass, and, for example, mercury, a noble gas, and a halogen are enclosed in the light emission section 12 of the arc tube 11. The mercury is enclosed as light emitting material and the amount of the enclosed mercury is, for example, 0.08 mg/mm$^3$ or more. The noble gas is enclosed in order improve the lighting starting nature of the lamp. The pressure of the enclosed noble gas is 10-26 kPa in static pressure. Moreover, as the noble gas, argon gas, for example, can be suitably used. The halogen forms a halogen cycle in the light emission section 12, and controls tungsten, which is an electrode substance, so that it does not to adhere to the inner wall of the light emission section 12. The amount of the enclosed halogen is, for example, $1\times10^{-6}$ to $1\times10^{-2}$ μmol/mm$^2$. Moreover, iodine, bromine, chlorine, etc. can be used as the halogen.

Figure 2:
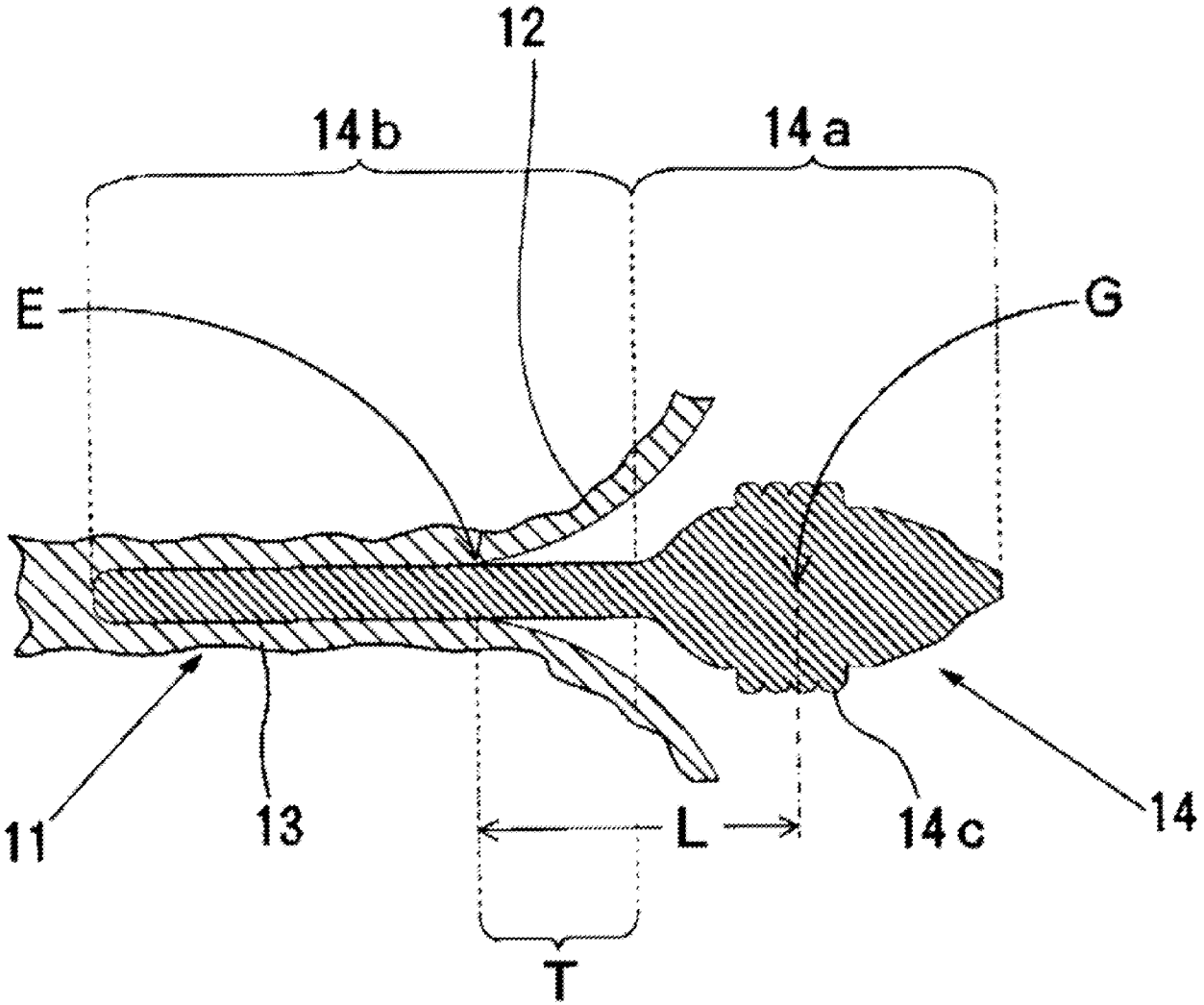
FIG. 2 is an enlarged cross sectional view of one of electrodes in a discharge lamp.

FIG. 2 is an enlarged cross sectional view of one of the electrodes 14. In this example, the electrode head portion 14*a* and the electrode axis portion 14*b* are integrally formed by cutting electrode material made of tungsten, which is in a suitable massive form. A coil portion 14*c* is formed by winding a wire rod made of tungsten around an outer circumferential face of the electrode head portion 14*a*. Moreover, it is desirable that tungsten having purity of 5N (99.999%) or greater be used as the tungsten which forms the electrode 14. Moreover, the other electrode 15 has the structure which is the same as or similar to that of the electrode 14 shown in FIG. 2.

Figure 3:
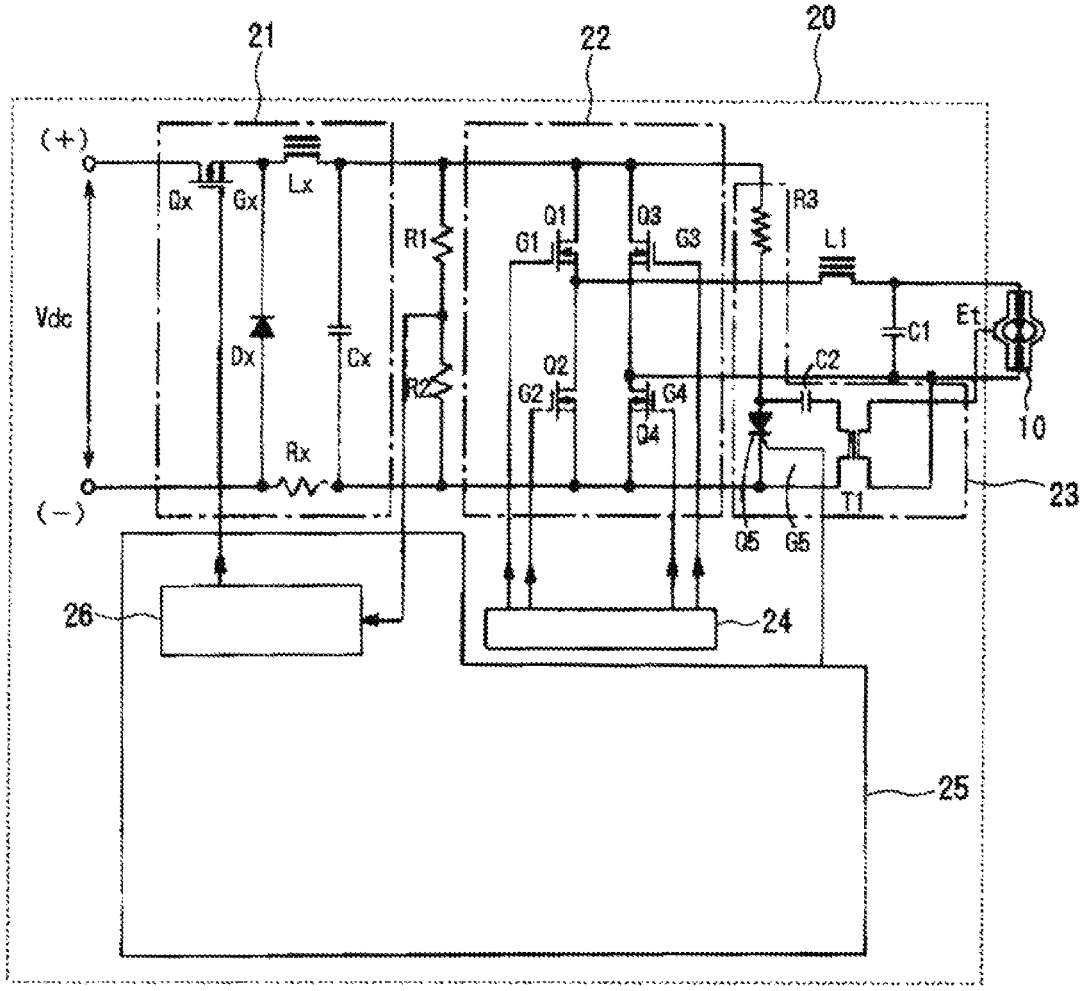
FIG. 3 is a diagram showing the structure of a circuit used as a power supply unit for a discharge lamp lighting apparatus.

FIG. 3 is an explanatory diagram showing an example of the structure of a circuit used as a power supply unit for the discharge lamp lighting apparatus according to an embodiment of the present invention. A power supply unit 20 comprises a step down chopper circuit 21 to which direct current voltage is supplied; a full bridge type inverter circuit 22 (hereinafter referred to as a "full bridged circuit") which is connected to an output side of the step down chopper circuit 21 and which converts direct current voltage into alternating current voltage and supplies it to the high pressure discharge lamp 10; an inductor L1, which is in series connected to the high pressure discharge lamp 10; a capacitor C1; a starter circuit 23; a driver 24, which drives switching elements Q1-Q4 of the full bridged circuit 22; and a control unit 25, which has a ripple control unit 26.

The step down chopper circuit 21 comprises a switching element Qx, which is connected to a plus terminal (+) of a power supply, direct current voltage being supplied to the switching element Qx; a reactor Lx; a diode Dx whose cathode side terminal is connected between a connection point of the switching element Qx and the reactor Lx, and a minus terminal (−) of the power supply; a smoothing capacitor Cx connected to an output side terminal of the reactor Lx; and a resistor Rx for current detection, which is connected between the minus side terminal of the smoothing capacitor Cx and the anode side terminal of the diode Dx. The switching element Qx is driven so as to be turned on and off at a predetermined duty, thereby stepping down direct current voltage Vdc to voltage which corresponds to the duty ratio. Moreover, a series circuit Vd for voltage detection, which is made up of resistors R1 and R2, is connected to an output side terminal of the step down chopper circuit 21.

The full bridged circuit 22 comprises four switching elements Q1-Q4 connected to one another so as to form a shape of a bridge. These switching elements Q1-Q4 are driven by operating drive circuits G1-G4, which correspond to the respective switching elements Q1-Q4, based on signals outputted from the driver 24. When the switching elements Q1 and Q4 and the switching element Q2 and Q3, which are diagonally arranged respectively, are turned on by turns, rectangle wave alternating current voltage occurs between a connection point of the switching elements Q1 and Q2 and a connection point of the switching element Q3 and Q4.

The starter circuit 23 comprises a series circuit, which is made up of a resistor R3 and a switching element Q5, a capacitor C2, and a transformer T1. In such a starter circuit 23, when the switching element Q5 is turned on by a drive circuit G5, electric charges charged in the capacitor C2 are discharged through the switching element Q5 and the primary side winding of the transformer T1, whereby pulse-like high voltage occurs in the secondary side of the transformer T1. And the discharge lamp 10 is lighted by impressing the high voltage to an auxiliary electrode Et of the discharge lamp 10.

The ripple control unit 26 in the control unit 25 has a function of controlling ripple power and ripple frequency of alternating current, which is supplied to the discharge lamp 10. Specifically, when an ON-OFF cycle of the switching element Qx of the step down chopper circuit 21 is made long and short, the ripple power and the ripple frequency of the alternating current supplied to the discharge lamp 10 change according to the ON-OFF cycle. Therefore, the ripple power and the ripple frequency of the alternating current supplied to the discharge lamp 10 are controlled so as to satisfy a formula (2) shown below, by adjusting the ON-OFF cycle of the switching element Qx by the ripple control unit 26.

In the discharge lamp lighting apparatus according to an embodiment of the present invention, the discharge lamp 10 is lighted by supplying alternating current to the discharge lamp 10 from the power supply unit 20. The electric power of the alternating current supplied to the discharge lamp 10 is, for example, 180-450 W. And the alternating current supplied to the discharge lamp 10 is controlled by the power supply unit 20 to satisfy a formula (2) set forth below, wherein in the present invention, the natural frequency of the electrodes 14 and 15 in the arc tube 11, which is obtained by a formula (1) set forth below, is represented as $f_e$ (Hz), the ripple frequency of the alternating current supplied to the discharge lamp 10 is represented as $f_d$ (Hz) and the ripple power of the alternating current is represented as Pr (W).

$$f_e = \left(\frac{a}{l_e}\right)^2 \cdot \sqrt{\frac{E \cdot I}{\rho \cdot S}} \quad \text{Formula (1)}$$

$$Pr \le |f_e - f_d| \cdot \left(-0.13 \times \frac{Vh}{Va} + 3.0\right) \quad \text{Formula (2)}$$

In the formula (1), the eigenvalue of bending vibration of a cantilever having a concentrated mass in the electrode is represented as "a". A value obtained by multiplying, by 0.623, a distance L (mm) from a base end E (refer to FIG. 2) of a portion T (refer to FIG. 2) of the electrode axis portion 14*b* (15*b*), which projects in the arc tube, to the center of gravity G of the electrode head portion 14*a* (15*a*) (refer to FIG. 2) is represented as "$l_e$". A Young's modulus of the electrode is represented as "E". Since the material of the electrodes 14 and 15 is tungsten, a value thereof is 280,000 MPa. A second moment of area of the electrode axis portion 14*b* (15*b*) is represented as "I". When the shape of the electrode axis portion 14*b* (15*b*) in a cross section taken along a direction perpendicular to the axial direction thereof is a circle and a diameter thereof is represented as d (mm), the relation thereof is expressed by $I=\pi d^4/64$. The density of the electrode 14 (15) is represented as "ρ". The material of the electrodes 14 and 15 is tungsten, so that a value thereof is $19.2\times10^{-6}$ (kg/mm$^3$). A cross-sectional area of a cross-section of the electrode axis portion 14*b* (15*b*) taken along a direction perpendicular to an axial direction is represented as "S". When the shape in a cross section of the electrode axis portions 14*b* (15*b*) taken along a direction perpendicular to the axial direction thereof is a circle and the diameter thereof is represented as "d", $S=\pi(d/2)^2$.

The "portion T of the electrode axis portion 14*b* (15*b*), which projects in the arc tube 12" means a portion which is spaced from the inner wall of the arc tube 11. However, in a portion located in the sealing portion 13 of the electrode axis portion 14*b* (15*b*), there may be a very slight gap between the sealing portion 13 and the electrode axis portion 14*b* (15*b*). Therefore, in the present invention, the "portion T of the electrode axis portion 14*b* (15*b*), which projects in the arc tube 11", is defined as a portion where a separation distance between the outer circumferential surface of the electrode axis portion 14*b* (15*b*) and the arc tube 11 is 10 μm (micrometers) or more. Moreover, in case where there is unevenness in the electrode axis portion 14*b* (15*b*), the "portion T of the electrode axis portions 14*b* (15*b*), which projects in the arc tube 11" is defined as a portion where a separation distance between a convex portion of the electrode axis portion 14*b* (15*b*) and the arc tube 11 is 10 μm or more.

In addition, in the formula (2), the volume (mm$^3$) of the electrode head portion 14*a* (15*a*) is represented as "Vh", and the volume (mm$^3$) of the portion T, which projects in the arc tube 11, is represented as "Va". Moreover, the ripple power [Pr] is obtained from an expression $Pr=V_L\times\Delta I$, wherein a voltage value of alternating current supplied to the discharge lamp 10 is represented as $V_L$ and a value which is twice the magnitude of the amplitude (ripple amplitude) of ripple in the alternating current is represented as ΔI.

In the discharge lamp lighting apparatus according to the present invention, the formula (2) was experimentally obtained by a test set forth below.

Production of Discharge Lamp

Based on the structure shown in FIG. 1, a discharge lamp A whose rated input electric power was 210 W, a discharge lamp B whose rated input electric power was 275 W, and a discharge lamp C whose rated input electric power was 330 W, were produced with specification set forth below.

Specification of Discharge Lamp A

ARC TUBE (11): The material of an arc tube (11) was silica glass. The maximum outer diameter of a light emission section (12) was 10 mm. The internal volume of the light emission section (12) was 66 mm$^3$.

ELECTRODE (14, 15): The material of electrodes (14, 15) was tungsten (the purity thereof was 99.999%), and the diameter (d) of each of electrode axis portions (14*b*, 15*b*) was 0.4 mm. The volume (Vh) of each of electrode head portions (14*a*, 15*a*) was 2.7 mm$^3$. A distance from a base end portion of the electrode axis portion (14*b*, 15*b*), which projected in an arc tube (11), to the center of gravity of the electrode head portion (14*a*, 15*a*) was 2.5 mm. The volume of each of the electrode axis portions (14*b*, 15*b*), which projected in the arc tube (11) was 0.63 mm$^3$. The natural frequency $f_e$ of each of the electrodes (14, 15) in the arc tube (11) was 76 kHz ($a=3.927$, $l_e=1.5575$, $E=280{,}000$ MPa, $I=1.256\times10^{-3}$, $\rho=19.2\times10^{-6}$ kg/mm$^3$, and $S=0.1256$ mm)$^2$.

ENCLOSED MATERIAL: Mercury of 0.2 mg/mm$^3$ as the light emitting material, and bromine of $4\times10^{-4}$ μmol/mm$^3$ as the halogen, were enclosed in the arc tube (11). Argon gas of 13 kPa enclosure pressure (static pressure) was enclosed as the noble gas therein.

Specification of Discharge Lamp B

ARC TUBE (11): The material of an arc tube (11) was silica glass. The maximum outer diameter of a light emission section (12) was 11.3 mm. The internal volume of the light emission section (12) was 80 $mm^3$.

ELECTRODES (14, 15): The material of electrodes (14, 15) was tungsten (the purity thereof was 99.999%). The diameter (d) of each of electrode axis portion (14*b*, 15*b*) was 0.4 mm. The volume (Vh) of each of electrode head portions (14*a*, 15*a*) was 4.0 $mm^3$. A distance from a base end portion of the electrode axis portion (14*b*, 15*b*), which projected in an arc tube (11), to the center of gravity of the electrode head portion (14*a*, 15*a*) was 2.9 mm. The volume of each of the electrode axis portions (14*b*, 15*b*), which projected in the arc tube (11) was $0.5=^3$. The natural frequency $f_e$ of each of the electrodes (14, 15) in the arc tube (11) was 71 kHz (a=3.927, $l_e$=1.813, E=280,000 MPa, I=$1.256\times10^{-3}$, ρ=$19.2\times10^{-6}$ kg/$mm^3$, and S=0.1256 $mm^2$).

ENCLOSED MATERIAL: Mercury of 0.2 mg/mm as the light emitting material, and bromine of $4\times10^{-4}$ μmol/$mm^3$ as the halogen, were enclosed in the arc tube (11). Argon gas of 13 kPa enclosure pressure (static pressure) was enclosed as the noble gas therein.

Specification of Discharge Lamp C

ARC TUBE (11): The material of an arc tube (11) was silica glass, and the maximum outer diameter of a light emission section (12) was 13 mm, and the internal volume of the light emission section (12) was 120 $mm^3$.

ELECTRODES (14, 15): The material of electrodes (14, 15) was tungsten (the purity thereof was 99.999%), and the diameter (d) of each of electrode axis portions (14*b*, 15*b*) was 0.5 mm. The volume (Vh) of each of electrode head portions (14*a*, 15*a*) was 5.0 $mm^3$. The distance from a base end portion of each of the electrode axis portions (14*b*, 15*b*), which projected in the arc tube (11), to the center of gravity of the electrode head portion (14*a*, 15*a*) was 3.2 mm. The volume of each of the electrode axis portions (14*b*, 15*b*), which projected in the arc tube (11) was 0.4 $mm^3$. The natural frequency $f_e$ of each of the electrodes (14, 15) in the arc tube (11) was 50.8 kHz (a=3.927, $l_e$=1.9936, E=280,000 MPa, I=$3.066\times10^{-3}$, ρ=$19.2\times10^{-6}$ kg/$mm^3$, and S=0.19625 $mm^2$).

ENCLOSED MATERIAL: Mercury of 0.2 mg/$mm^3$ as the light emitting material, and bromine of $4\times10^{-4}$ μmol/$mm^3$ as the halogen, were enclosed in the arc tube (11). Argon gas of 13 kPa enclosure pressure (static pressure) was enclosed as the noble gas therein.

Continuous Lighting Test of Discharge Lamps

Two or more discharge lamps with the above specification of each of the discharge lamps A-C were respectively prepared. In these discharge lamps, a low frequency component of 46.25 Hz was inserted by one cycle every 100 msec of fundamental frequency component of 370 Hz. The continuous lighting test for continuously lighting these lamps for 300 hours by alternating current with rated input electric power value, was carried out by changing the ripple power and the ripple frequency of the alternating current supplied to the discharge lamps, whereby a state of each discharge lamp was examined. A result thereof is shown in FIGS. 4, 5, and 6.

Analysis of Test Result

Figure 4:
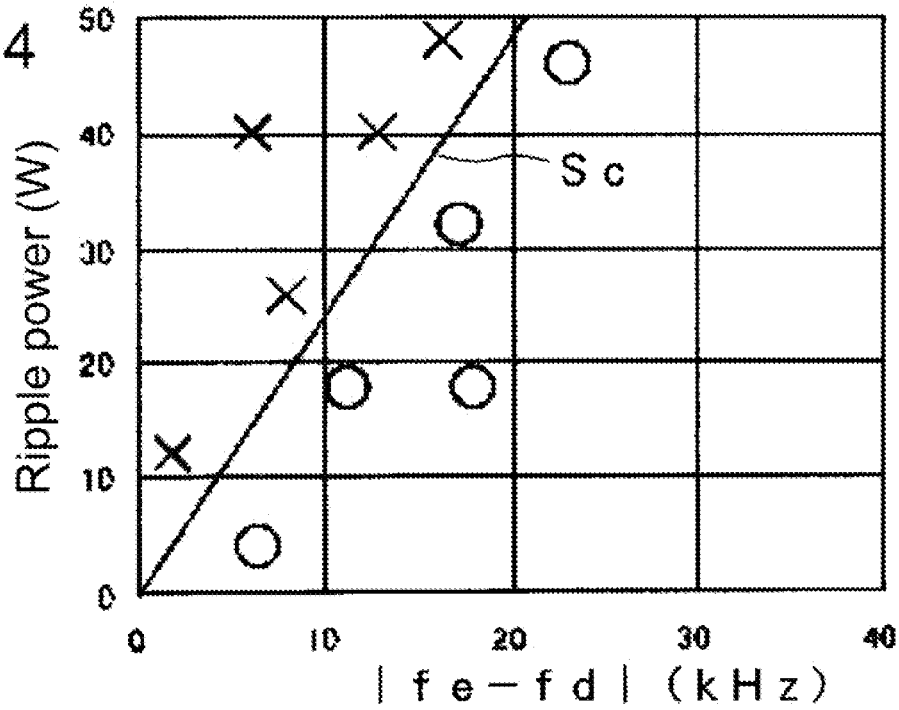
FIG. 4 is a graph which shows the existence and non-existence of damage produced in electrodes of a discharge lamp A after the end of a continuous lighting test.

FIG. 4 is a graph showing existence and non-existence of damage in the electrodes of the discharge lamp A after the end of the continuous lighting test, in view of a relation between a difference of the natural frequency of the electrodes and the ripple frequency of alternating current, and the ripple power of the alternating current. FIG. 5 is a graph showing existence and non-existence of damage in the electrodes of the discharge lamp B after the end of the continuous lighting test, in view of a relation between a difference of the natural frequency of the electrode and the ripple frequency of alternating current, and ripple power of the alternating current. FIG. 6 is a graph showing existence and non-existence of damage in the electrodes of the discharge lamp C after the end of the continuous lighting test, in view of a relation between a difference of the natural frequency of the electrodes and the ripple frequency of alternating current, and ripple power of the alternating current. In FIGS. 4, 5, and 6, the horizontal axis respectively represents an absolute value of a difference [$|f_e-f_d|$] between the natural frequency [$f_e$] of an electrode, and the ripple frequency [$f_d$] of alternating current (hereinafter referred to as "absolute value [$|f_e|f_d|$]"), and the vertical axis represents the ripple power (Pr) of the alternating current, wherein the symbol "○" indicates a discharge lamp, in which no damage in the electrode was observed after the end of the continuous lighting test, and the symbol "x" indicates a discharge lamp, in which damage in the electrode was observed after the end of the continuation lighting test.

Figure 5:
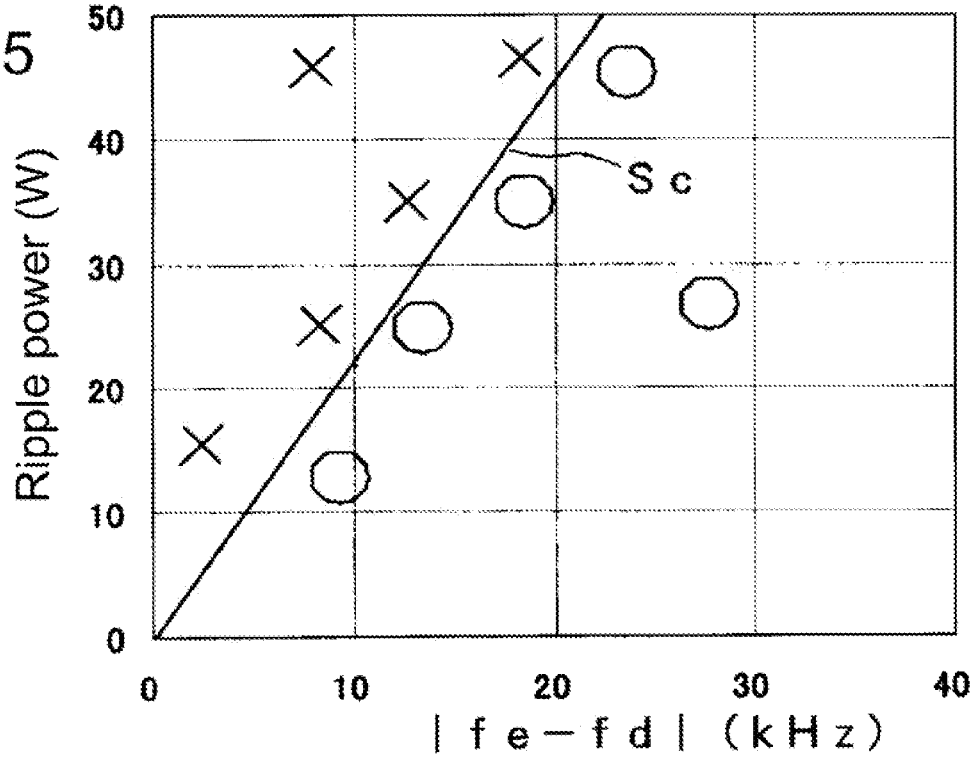
FIG. 5 is a graph which shows the existence and non-existence of damage produced in the electrode of the discharge lamp B after the end of a continuous lighting test.
Figure 6:
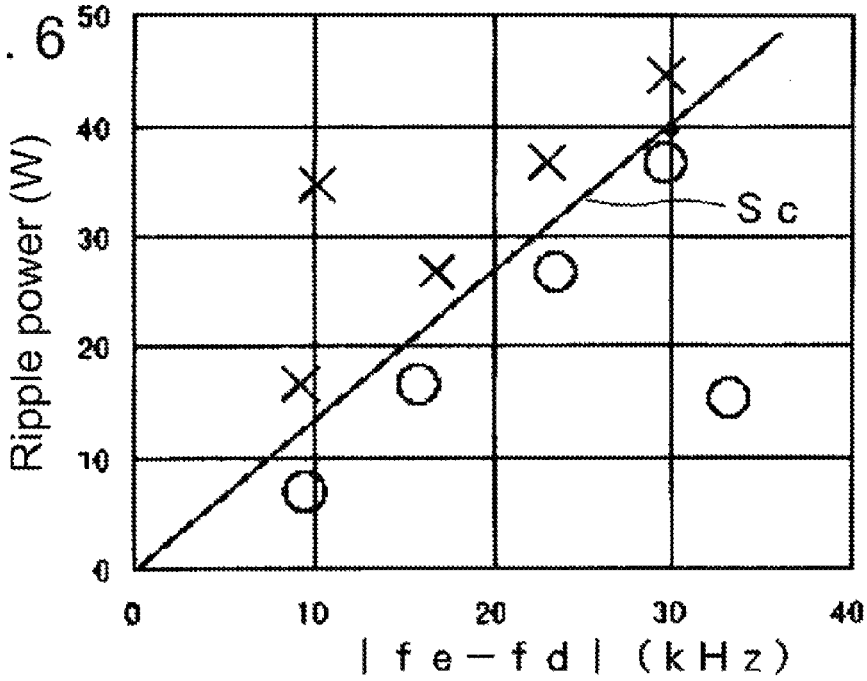
FIG. 6 is a graph which shows the existence and non-existence of damage produced in the electrode of the discharge lamp C after the end of a continuous lighting test.

As is clear from FIGS. 4-6, in all of the discharge lamp A-C, as the absolute value [$|f_e|f_d|$] was small, that is, the ripple frequency [$f_d$] of the alternating current came near the natural frequency [$f_e$] of the electrode, damage tended to occur in the electrode even if the ripple power was small. In other words, as the absolute value [$|f_e-f_d|$] was great, it became difficult to produce damage in the electrode even if the ripple power was large. Moreover, in analysis of the distribution of the existence and non-existence of damage in the electrodes with respect to each of FIGS. 4-6, it turned out that there was a critical line as shown as a straight line Sc in each figure. In other words, when a value of ripple power was equal to or less than a value located on the straight line Sc, which was a critical line in a relation with the absolute value [$|f_e-f_d|$], damage in the electrode did not occur. Therefore, when the natural frequency of the electrodes in the arc tube 11 was represented as $f_e$ (Hz), the ripple frequency of the alternating current supplied to the discharge lamp was represented as $f_d$, the ripple power of the alternating current was represented as Pr (W), and the slope of the straight line Sc in each of FIGS. 4-6 was represented as g, no damage occurred if a formula (2-1) set forth below was satisfied.

$$Pr \leq |f_e-f_d| \times g \qquad \text{Formula (2-1):}$$

Figure 7:
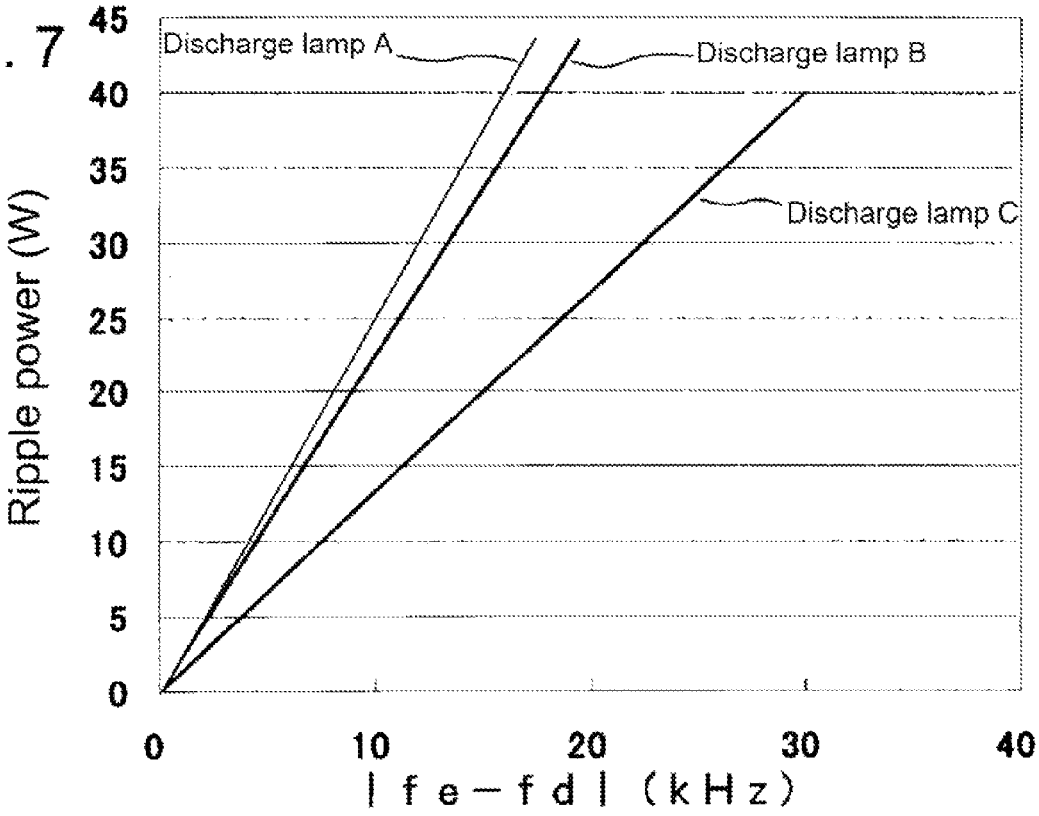
FIG. 7 is a graph which shows a critical line of the existence and non-existence of damage in electrodes of each of discharge lamps A-C.

Moreover, the function of the straight line Sc, which was a critical line, was obtained. That is, in FIG. 4, y=2.3333x, in FIG. 5, y=2.2x, and in FIG. 6, y=1.32x. As shown also in FIG. 7, it was confirmed that the slope of the straight line Sc changed depending on the specification of the discharge lamp. And in FIGS. 4-6, as a result of analysis about the change of slope of the straight line Sc, which was a critical line, it was found that it depended on the shape and the size of the electrode. Specifically, in the electrodes of the discharge lamp to which large rated input electric power was supplied, a large volume of the electrode head portion was required. On the other hand, in order to prevent damage of the arc tube due to a difference in thermal expansion between the electrode material and the arc tube material during lighting of the discharge lamp, it was desirable that the diameter of the electrode axis portion be small. Therefore, as the rated input electric power of the discharge lamp became large, the electrodes in which a ratio of the volume of the electrode head portion and that of the electrode axis portion was large, were used.

The above-mentioned discharge lamps A-C are referred to below. As to the discharge lamp A whose rated input electric power was 210 W, a ratio [Vh/Va] of the volume [Vh] of the electrode head portion to the volume [Va] of the electrode axis portion, which projected from the arc tube (hereinafter referred to as "head axis volume ratio"), was 4.28. As to the discharge lamp B whose rated input electric power was 275 W, the head axis volume ratio [Vh/Va] was 7.94. As to the discharge lamp C whose rated input electric power was 330 W, the head axis volume ratio [Vh/Va] was 12.5.

Figure 8:
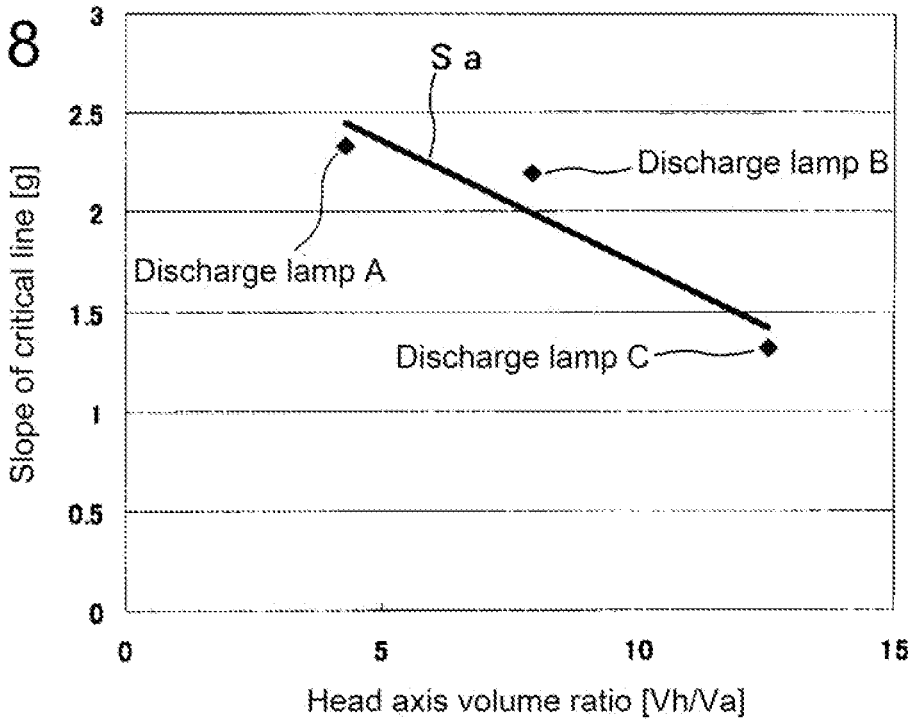
FIG. 8 shows a graph plotting a ratio of the volume of an electrode head portion and the volume of an electrode axis portion which projects from an arc tube, and a slope of a critical line of the existence and non-existence of damage in the electrode axis portion, in each of discharge lamps A to C.

As shown in FIG. 8, plotting was made to make a graph in which the horizontal axis represented a head axis volume ratio [Vh/Va], and the vertical axis represented slope [g] of a critical line (straight line Sc), with respect to each of the discharge lamps A-C based on a value of the head axis volume ratio [Vh/Va] and a value of the slope of the critical line (straight line Sc) as to the vertical axis, whereby the function of the approximation straight line Sa was obtained from each plot, that is, y=−0.13x+3.0. Since "y" was the slope [g] of the straight line Sc, and "x" was the head axis volume ratio [Vh/Va], the following expression (2-2) was obtained, wherein the volume of the electrode head portion was represented as "Vh", the volume of the electrode axis portion which projects in the arc tube was represented as "Va", and the slope of the straight line in each of FIGS. 4-6 was represented as "g":

$$g=-0.13\times(Vh/Va)+0.3 \qquad \text{Formula (2-2):}$$

The formula (2) was obtained by substituting the formula (2-2) into the formula (2-1).

According to the discharge lamp lighting apparatus of an embodiment of the present invention, when alternating current supplied to the discharge lamp from the power supply unit satisfies the above-mentioned formula (2), since vibration produced in the electrode during lighting of the discharge lamp 10 is small, even if the discharge lamp is lighted for a long time, it is possible to prevent or control damage in the electrode axis portion.

Figure 9:
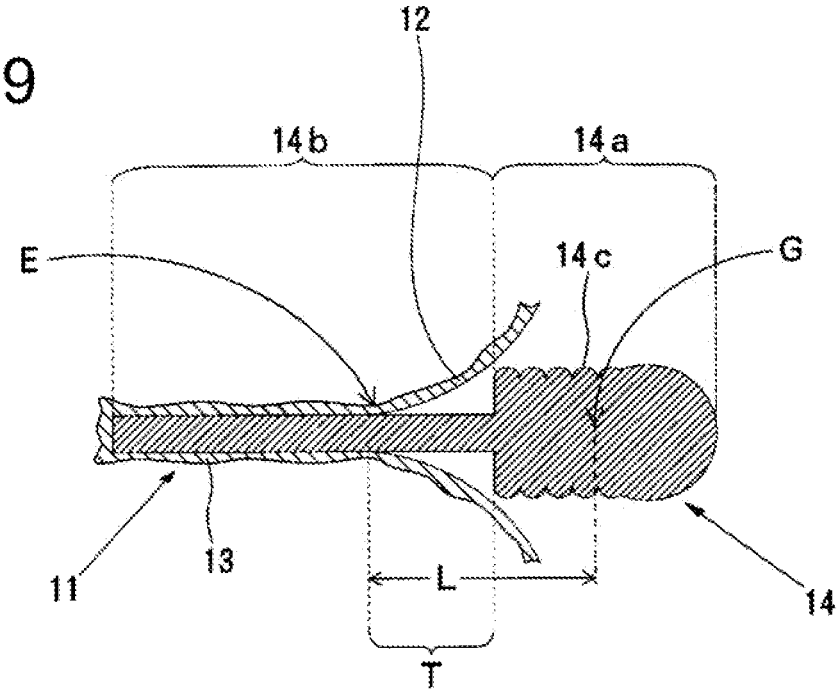
FIG. 9 is a cross sectional view of a modified example of an electrode in a discharge lamp.
Figure 10:
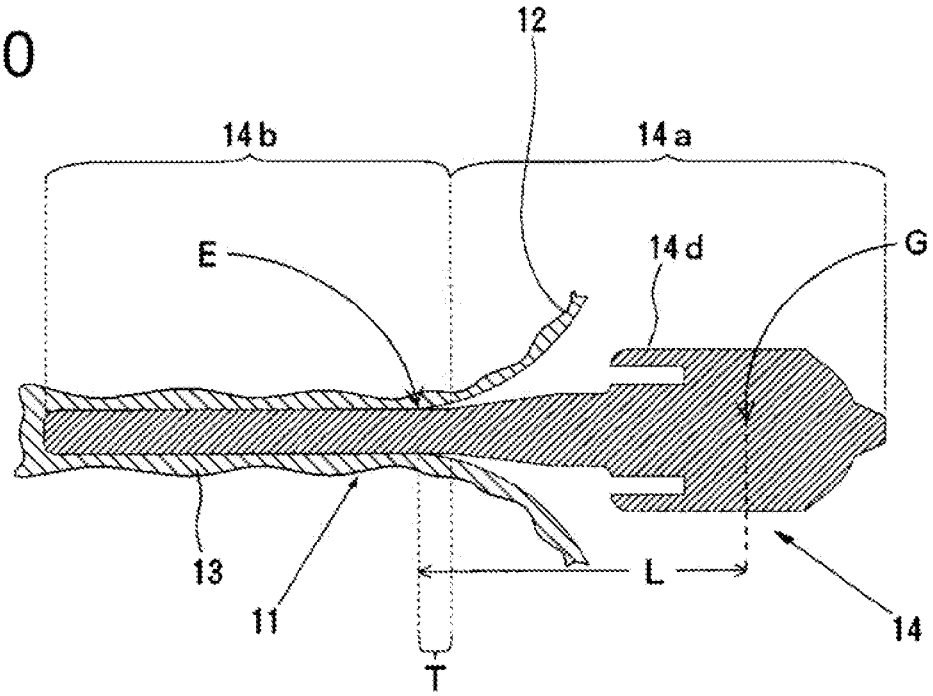
FIG. 10 is a cross sectional view of another modified example of an electrode in a discharge lamp.
Figure 11A:
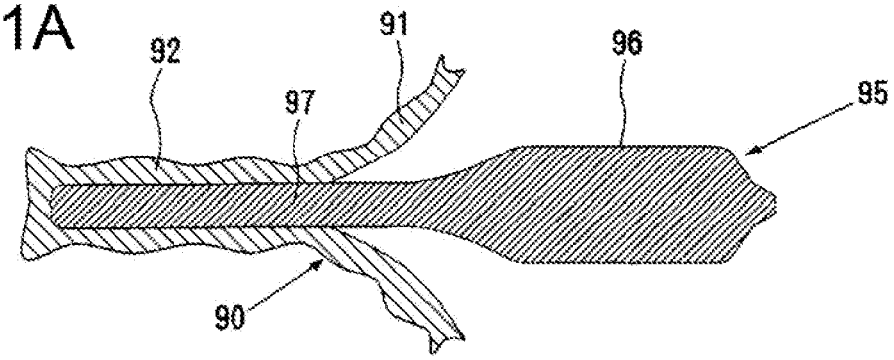
FIGS. 11A and 11B are explanatory cross sectional views of an electrode, showing a state of an electrode axis portion that is elastically deformed during lighting of a discharge lamp.
Figure 11B:
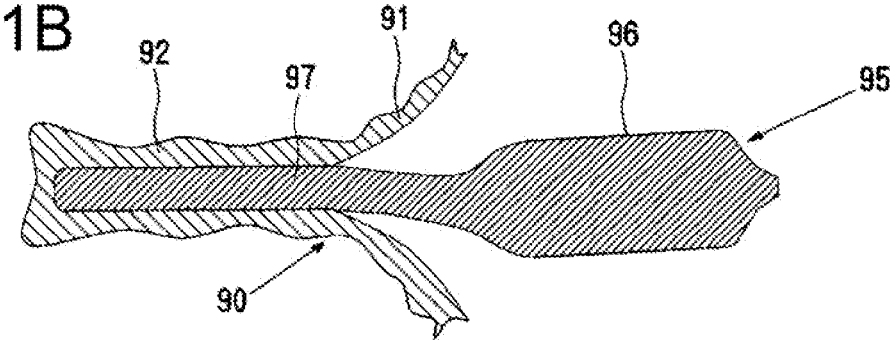

The discharge lamp lighting apparatus according to the present invention is not limited to the above-described embodiments, and various modifications can be made thereto. For example, as long as the electrodes 14 and 15 of the discharge lamp 10 are made of tungsten and the electrode head portions 14*a* and 15*a* are formed at the tips of the respective electrode axis portions 14*b* and 15*b*, the structure thereof is not limited specifically. For example, as shown in FIG. 9, the electrode may have a coil portion 14*c*, which is formed by melting a coil wound around the electrode head portion 14. As shown in FIG. 10, a cylindrical portion 14*d*, which has the same outer diameter as the diameter of the back end of the electrode head portion 14*a*, may be formed at a back end face of the electrode head portion 14*a*. Moreover, the pair of electrodes 14 and 15 may have different structures from each other.

The preceding description has been presented only to illustrate and describe exemplary embodiments of the present discharge lamp lighting apparatus. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A discharge lamp lighting apparatus comprising:

a short arc type discharge lamp including an arc tube in which a pair of tungsten electrodes is arranged so as to face each other, each electrode comprising an electrode head portion which is formed at a tip of an electrode axis portion, a base end portion of the electrode axis portion is buried and held in a sealing portion of the arc tube, the electrode axis portion including a projection portion that projects into the arc tube; and a power supply unit, that supplies an alternating current to the discharge lamp, configured to supply the alternating current such that a relation of a natural frequency fe (Hz) of the electrodes in the arc tube, which is obtained by a formula (1) shown below, a ripple frequency fd (Hz) of the alternating current, and a ripple power Pr (W) of the alternating current, satisfies a formula (2) shown below:

wherein the formula (1) is $$f_e=\left(\frac{a}{l_e}\right)^2\cdot\sqrt{\frac{E\cdot I}{\rho\cdot S}}$$

wherein, for a given electrode, an eigenvalue of bending vibration of a cantilever having a concentrated mass in the electrode is represented as "a", a value obtained by multiplying 0.623 by a distance (mm) from a base end of the projection portion of the electrode axis portion to the center of gravity of the electrode head portion, is represented as "le", a Young's modulus of the electrode is represented as "E", a second moment of area of the electrode axis portion is represented as "I", and a density of the electrode is represented as "p", and a cross-sectional area of a cross-section of the electrode axis portion taken along a direction perpendicular to an axial direction is represented as "S", wherein the formula (2) is $$Pr\le|f_e-f_d|\cdot\left(-0.13\times\frac{Vh}{Va}+3.0\right)$$

wherein the volume ($mm^3$) of the electrode head portion is represented as "Vh" and the volume ($mm^3$) of the projection portion of the electrode axis portion is represented as "Va".

2. The discharge lamp lighting apparatus according to claim 1, wherein the purity of the tungsten that forms the electrodes is 5N or more.

* * * * *